US007156458B2

(12) United States Patent
Hanberg

(10) Patent No.: US 7,156,458 B2
(45) Date of Patent: Jan. 2, 2007

(54) CHAIR COVER WITH CHILD RESTRAINT BELT

(76) Inventor: Jimmie K. Hanberg, 1103 Pennsylvania Ave., Slidell, LA (US) 70458

( * ) Notice: Subject to any disclaimer, the term of this patent is extended or adjusted under 35 U.S.C. 154(b) by 0 days.

(21) Appl. No.: 11/052,298

(22) Filed: Feb. 8, 2005

(65) Prior Publication Data

US 2005/0264056 A1 Dec. 1, 2005

Related U.S. Application Data

(60) Provisional application No. 60/573,833, filed on May 25, 2004.

(51) Int. Cl.
*A47C 31/00* (2006.01)

(52) U.S. Cl. ..... 297/219.12; 297/219.1; 297/219.11; 297/228.1

(58) Field of Classification Search ..... 297/225, 297/227, 228, 228.1, 229, 219.12, 219.11, 297/219.1, 250.1, 216.11, 452.58, 485
See application file for complete search history.

(56) References Cited

U.S. PATENT DOCUMENTS 3,604,750 A * 9/1971 Doering ..... 297/467
4,235,474 A * 11/1980 Rosenberg ..... 297/465
4,568,125 A * 2/1986 Sckolnik ..... 297/467
4,651,366 A * 3/1987 Lande et al. ..... 5/98.1
4,759,588 A 7/1988 Husnik
4,871,210 A * 10/1989 Alexander et al. ..... 297/485
4,891,454 A * 1/1990 Perdelwitz et al. ..... 428/137
5,042,878 A * 8/1991 Collins ..... 297/467
5,354,121 A * 10/1994 Allum ..... 297/485
D360,308 S 7/1995 Smith et al.
5,468,020 A * 11/1995 Scime ..... 280/808
5,626,397 A * 5/1997 Reid ..... 297/467
5,678,888 A * 10/1997 Sowell et al. ..... 297/256.17
5,690,380 A 11/1997 Waters
5,967,607 A * 10/1999 Waldroup ..... 297/256.17
5,988,744 A * 11/1999 Franchak ..... 297/256.17
6,129,418 A * 10/2000 Bergh et al. ..... 297/256.17
6,155,637 A 12/2000 Waters
6,237,998 B1 5/2001 Aprile
6,247,755 B1 * 6/2001 Canna et al. ..... 297/468
6,428,098 B1 * 8/2002 Allbaugh ..... 297/219.12
6,702,381 B1 * 3/2004 Endicott et al. ..... 297/256.17
6,817,663 B1 * 11/2004 Stuart ..... 297/219.12
6,929,326 B1 * 8/2005 Cohen-Fyffe ..... 297/219.12

* cited by examiner

*Primary Examiner*—Peter M. Cuomo
*Assistant Examiner*—Erika Garrett
(74) *Attorney, Agent, or Firm*—Richard C. Litman

(57) ABSTRACT

The chair cover with child restraint belt is a cover configured to fit over the upper portion of a stackable chair for securing a young child to the chair. The cover is constructed of a layer of absorbent material positioned between two cloth layers and has a back portion, a seat portion and two arm portions. An adjustable belt with two buckles is attached to the back and seat portions of the cover. A retaining panel extends between the two arm portions to help prevent a child's toys or other items from falling off of the cover. In an alternative embodiment the cover is made of a cloth covered with waterproof material.

5 Claims, 6 Drawing Sheets

CHAIR COVER WITH CHILD RESTRAINT BELT

CROSS-REFERENCE TO RELATED APPLICATION

This application claims the benefit of U.S. Provisional Patent Application Ser. No. 60/573,833, filed May 25, 2004.

BACKGROUND OF THE INVENTION

1. Field of the Invention

The present invention relates to chair covers and, more particularly, to a chair cover with an attached child restraint belt. The cover is adapted to fit over a stackable chair and the restraint belt is adapted to secure a young child thereto.

2. Description of the Related Art

Stackable chairs are used in numerous settings including churches, schools, community centers, government offices and businesses. Typically, each of these chairs includes a cloth back, a cloth seat, two arms and four legs, with the seat and legs configured to rest on top of the seat and legs of another chair. Because these chairs can be stacked together on top of a small cart, they are easily transported and require minimal storage space.

Although widely used, stackable chairs have a well-known drawback. The chairs are not useful for young children, ages six months to three years old. While parents often must bring a young child to a place where stackable chairs are the only chairs available, these chairs are neither safe for young children nor resistant to staining associated with young children. The chairs do not include a means for securing a child in an upright position or a means for preventing a child from falling through the opening between the back and the seat or an opening in the arms, and the cloth coverings of the back and seat are susceptible to stains from spilled food and drink.

Thus, a need exists for a means of securing a child to a stackable chair and protecting the cloth back and seat of the chair from stains associated with a young child. Furthermore, a need exists for such a device having a structure that will also prevent a young child's toys or other items from falling off of a stackable chair in which the child is sitting.

U.S. Design Pat. No. 360,308, issued Jul. 18, 1995 to Smith et al., shows a child seat that attaches to the back of a chair. The device does not completely cover the top portion of the chair and does not include arm cover portions or a retaining panel. U.S. Pat. No. 4,759,588, issued Jul. 26, 1988 to M. J. Husnik, describes a child car seat that is adapted for attachment to a standard car seat and that includes a belt adapted to resemble a pair of "hugging" arms. The device is not adapted to cover a chair and does not include arm cover portions or a retaining panel.

U.S. Pat. No. 5,354,121, issued Oct. 11, 1994 to R. J. Allum, describes a restraint device for a small child that can be attached to a chair. The device is not adapted to cover a stackable chair and does not include arm cover portions or a retaining panel. U.S. Pat. No. 5,690,380, issued Nov. 25, 1997 to A. Waters, describes covers for folding and non-folding chairs. The covers do not include a child restraint belt or a retaining panel.

U.S. Pat. No. 5,988,744, issued Nov. 23, 1999 to L. Franchak, describes a child safety seat comprised of a single panel with a waist belt. The device is not adapted to cover a stackable chair and does not include arm cover portions or a retaining panel. U.S. Pat. No. 6,155,637, issued Dec. 5, 2000 to A. Waters, describes a cover for glider rockers and similar chairs. The cover does not include a child restraint belt or a retaining panel.

U.S. Pat. No. 6,237,998, issued May 29, 2001 to S. S. Aprile, describes a cover for the child seat of a shopping cart. The cover is not adapted to cover a chair. U.S. Pat. No. 6,438,098, issued Aug. 6, 2002 to F. B. Allbaugh, describes a liner for a high chair. The liner is not adapted to cover a chair and does not include a retaining panel.

None of the above inventions and patents, taken either singly or in combination, is seen to describe the instant invention as claimed. Thus, a chair cover with child restraint belt solving the aforementioned problems is desired.

SUMMARY OF THE INVENTION

The chair cover with child restraint belt is a cover configured to fit over the upper portion of a stackable chair for securing a young child to the chair. The cover is constructed of a layer of absorbent material positioned between two cloth layers and has a back portion, a seat portion and two arm portions. An adjustable belt with two buckles is attached to the back and seat portions of the cover. A retaining panel extends between the two arm portions to help prevent a child's toys or other items from falling off of the cover. In an alternative embodiment the cover is made of a cloth-covered waterproof material.

The chair cover of the present invention allows a young child to be safely secured to a stackable chair, while the chair is protected from stains caused by the child. The child is secured in an upright sitting position, and a retaining panel helps prevent the child's toys or other items from falling off of the chair.

Accordingly, it is a principal object of the invention to provide a chair cover with a restraining belt that allows a young child to be safely secured to a stackable chair.

It is another object of the invention to provide a chair cover with a restraining belt that protects a chair from stains caused by a child sitting in the chair.

It is a further object of the invention to provide a chair cover with a restraining belt that helps to prevent a child's toys or other items from falling off of a chair in which the child is sitting.

Still another object of the invention is to provide a chair cover with a restraining belt that helps to train a young child to sit in an upright position.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
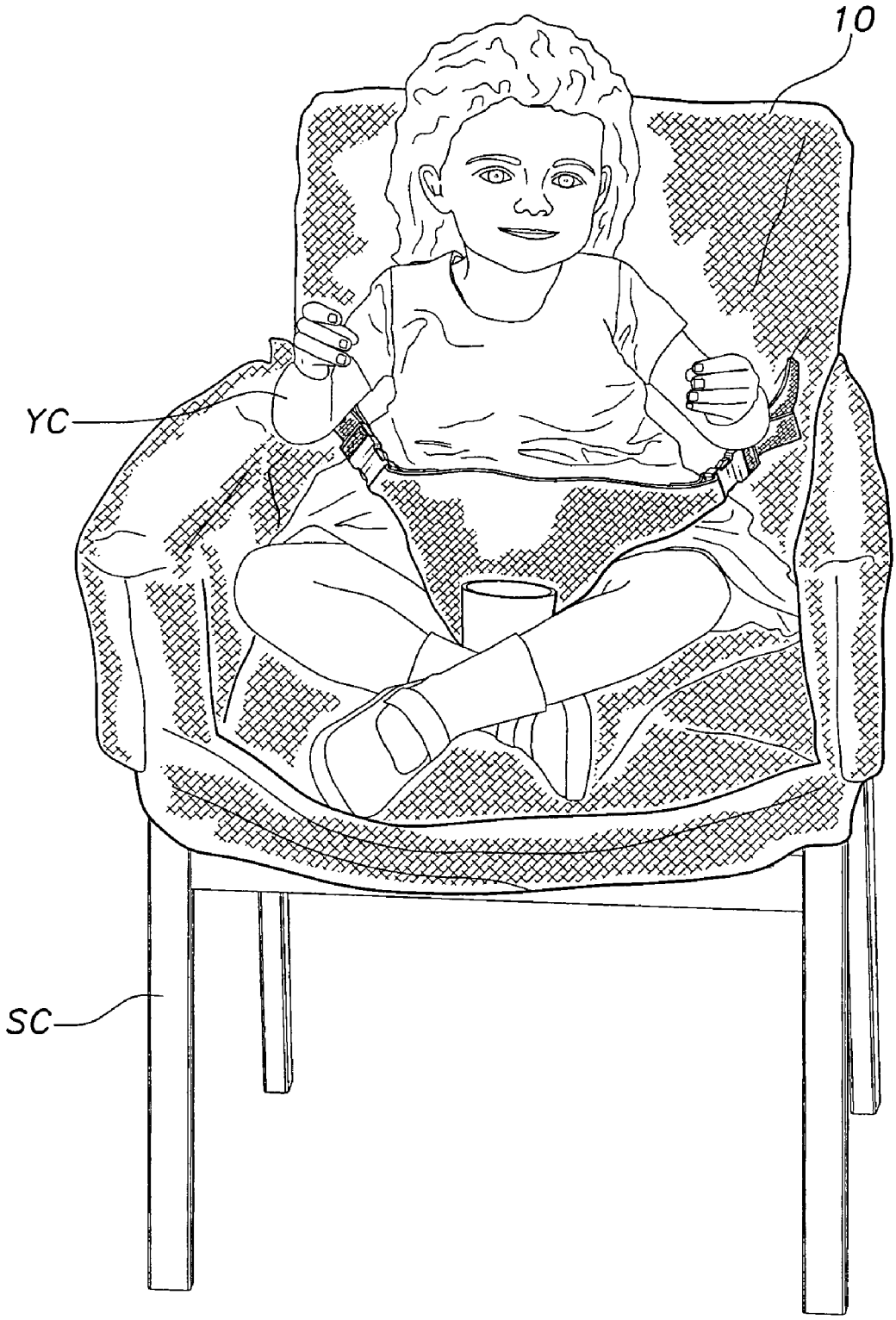
FIG. 1 is an environmental, perspective view of a chair cover with child restraint belt according to the present invention shown securing a child to a chair.

The present invention is a chair cover with child restraint belt, designated generally as 10 in the drawings. The chair cover with child restraint belt 10 is configured to secure a young child YC to a stackable chair SC as shown in FIG. 1.

Figure 2A:
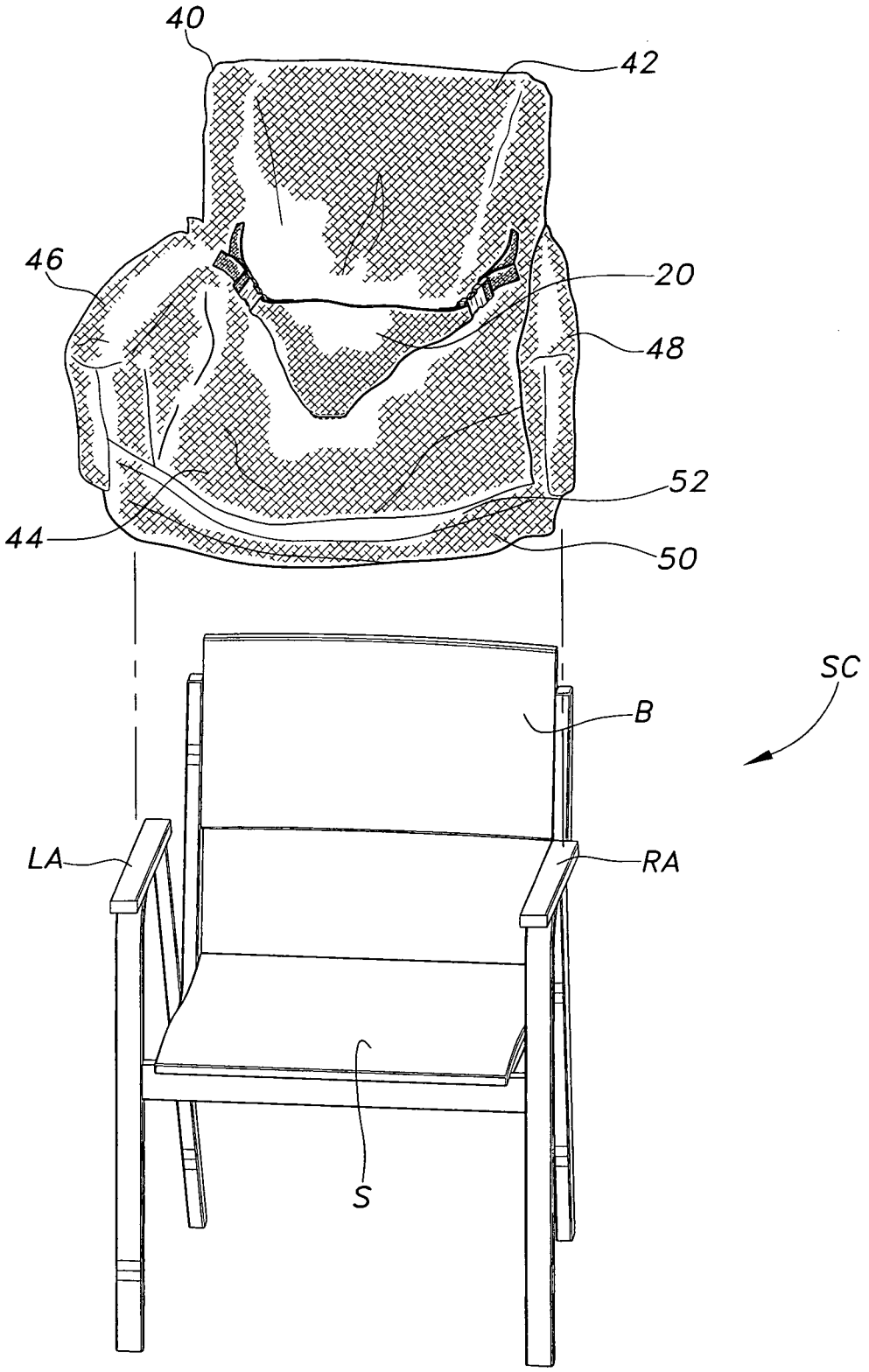
FIG. 2A is a perspective view of a chair cover with child restraint belt according to the present invention shown in relation to a stackable chair.
Figure 3:
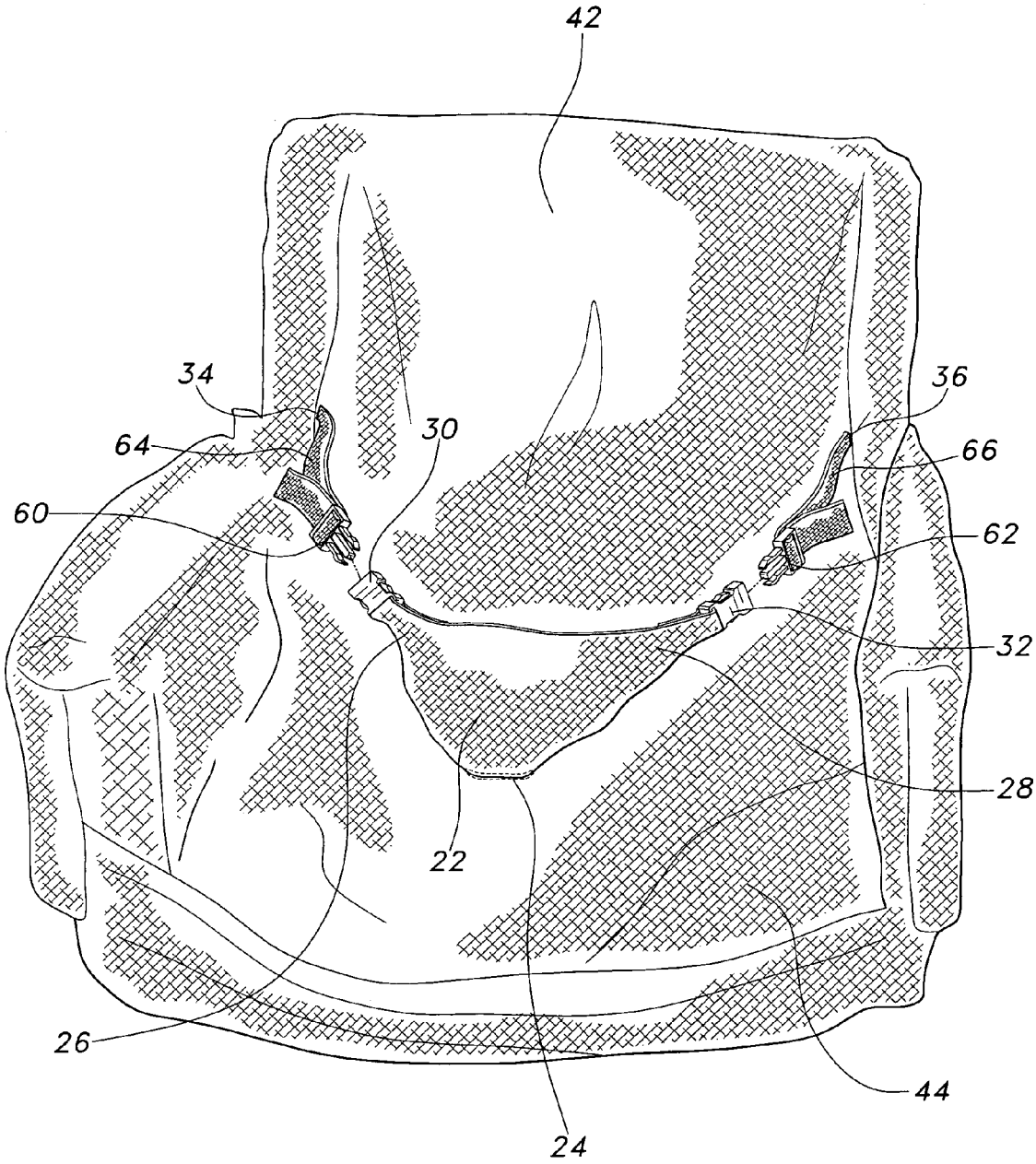
FIG. 3 is a perspective view of a cover for a chair cover with child restraint belt according to the present invention shown with the restraint belt unbuckled.

Referring to FIGS. 2A and 3, the chair cover with child restraint belt 10 includes a cover 40 and a child restraint belt 20. The cover 40 is adapted to fit over the upper portion of a stackable chair SC and has a back portion 42, a seat portion 44, a left arm portion 46, a right arm portion 48, a front portion 50 and a retaining panel 52. The back portion 42, left arm portion 46 and right arm portion 48 each form an inverted pocket that slides over, respectively, the chair back B, the left arm LA of the chair and the right arm RA of the chair, as reflected in FIG. 2A. The front portion 50 extends downward from the front edge of the seat portion 44 between the left arm 46 and right arm 48 portions, and the retaining panel 52 extends upward from the front edge of the seat portion 44 between the left arm 46 and right arm 48 portions. The retaining panel 52 provides a sort of barrier at the front edge of the seat portion 44 to prevent toys or other items from falling off of the cover 40. The retaining panel 52, therefore, creates a generally enclosed environment for the young child YC.

Figure 2B:
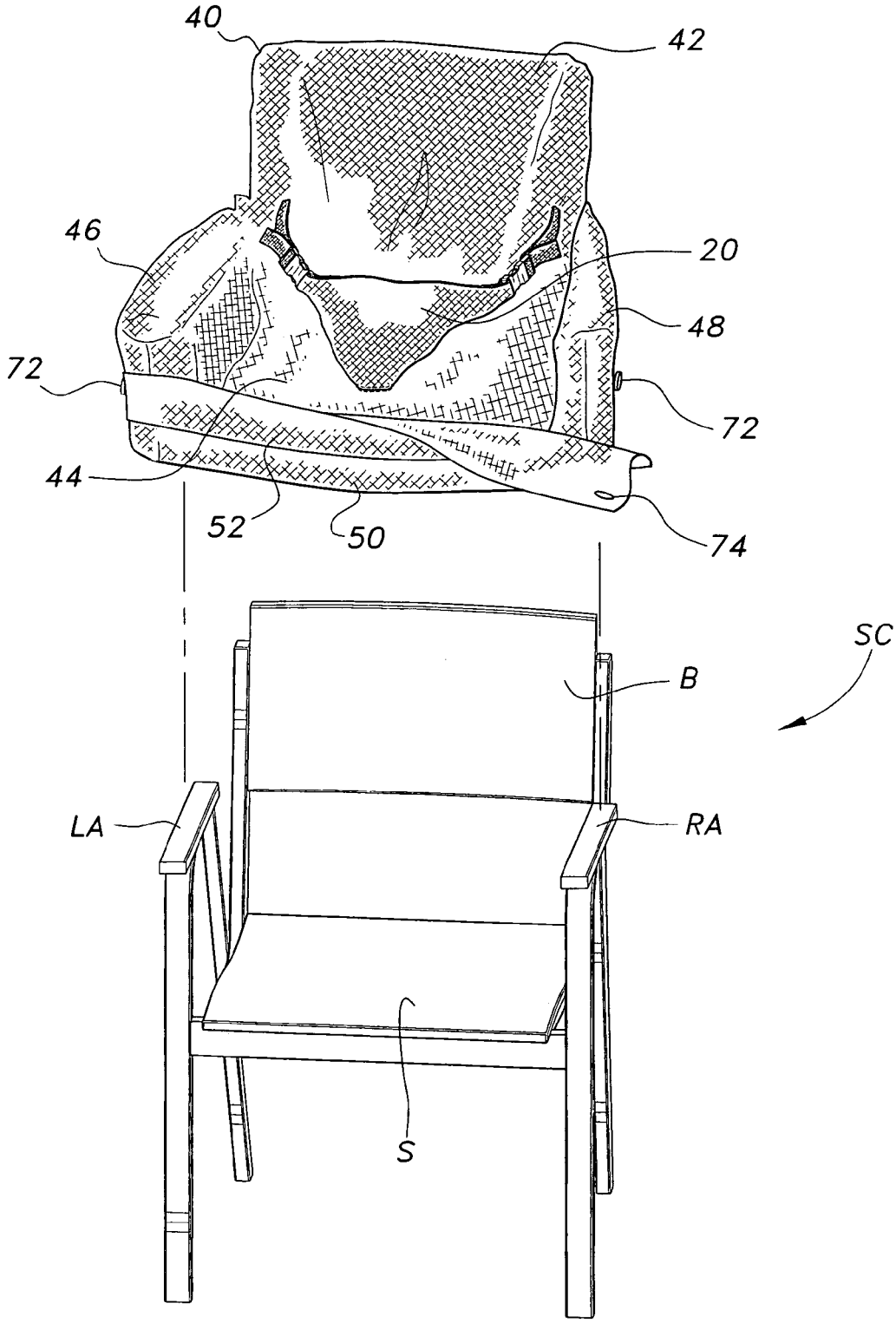
FIG. 2B is a perspective view of an alternative embodiment of a chair cover with child restraint belt according to the present invention.

FIG. 2B shows an alternative embodiment of the chair cover. Comparing FIG. 2A to FIG. 2B, the retaining panel 52, as mentioned above, extends upward and between the left arm 46 and right arm 48 portions. Ends of the retaining panel 52 may be sewn to each the left arm 46 and right arm 48 portions fixing the retaining panel 52 permanently in place, as shown in FIG. 2A. Alternatively, the retaining panel 52 may be removably attached to the outer sides of each the left arm 46 and the right arm 48 portions using fasteners 72.

As shown in FIG. 2B, the fastener 72 is a button that engages a corresponding eyelet or buttonhole 74 for the button fastener 72. The fasteners 72 are disposed on the sides of the arms 46, 48. The retaining panel 52 is thus held taut between the arms 46, 48.

Although fasteners 72 are illustrated as buttons in the drawings, it will be understood that other types of releasable fastening means may be used in place of buttons, such as hook and loop material, snaps, etc. By using fasteners 72 to removably attach the retaining panel 52 to the left arm 46 and right arm 48, the cover 10 be used by children who have outgrown the need for the retaining panel 52 and others who may want to use the cover 10 without the retaining panel 52.

Referring now to FIG. 3, the child restraint belt 20 has a first end 34, a second end 36 and a midsection 22. The midsection 22 has two arms 26 and 28, and also a lower edge 24 that is attached to the seat portion 44. The female portion 30 and 32 of a buckle is attached to the end of each arm 26 and 28. The mating male portion 60 and 62 of each buckle is attached to a strap 64 and 66. The first end 34 is at the distal end of the first strap 64 and the second end 36 is at the distal end of the second strap 66. Both the first and second ends 34 and 36 are attached to the back portion 42. The male portions 60 and 62 are adjustable along the length of each strap 64 and 66.

Figure 4A:
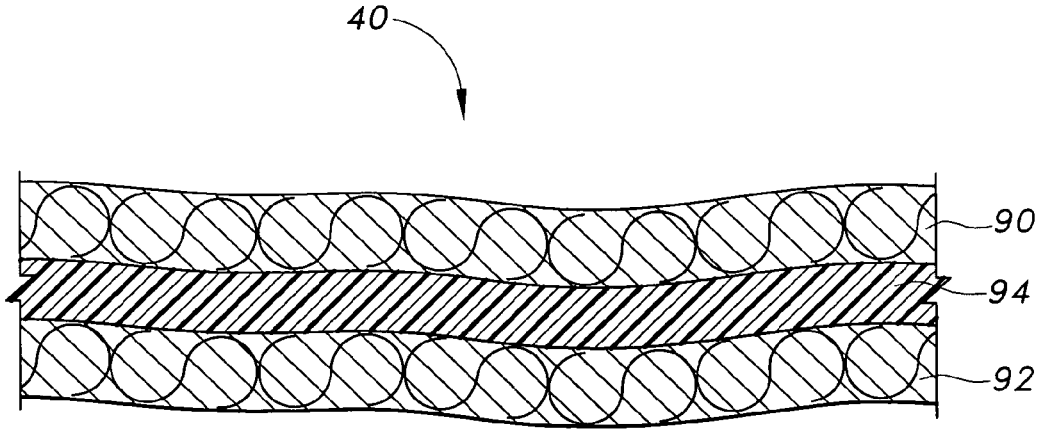
FIG. 4A is fragmented sectional view of the chair cover of the present invention showing the layers of material according to a first embodiment of the present invention.
Figure 4B:
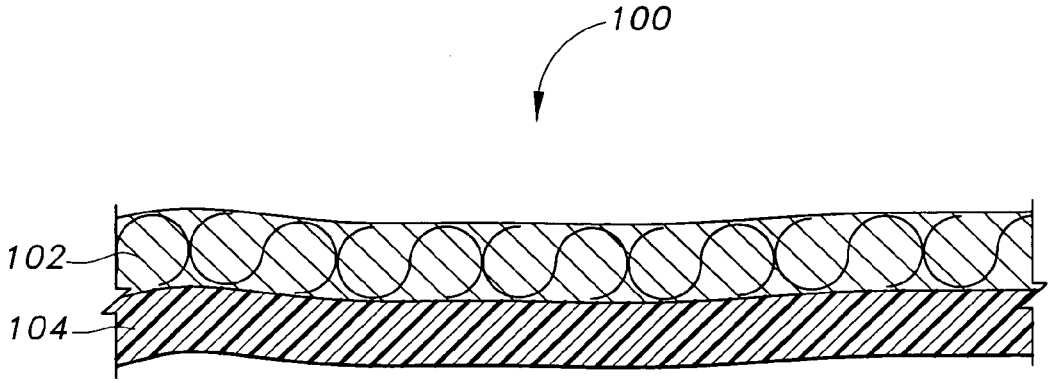
FIG. 4B is fragmented sectional view of the chair cover of the present invention showing the layers of material according to a second embodiment of the present invention.

The cover 40 is preferably constructed of a material having three layers 90, 92 and 94 as shown in FIG. 4A. The two outer layers 90 and 92 are cloth and the inner layer 94 is an absorbent material. In an alternative embodiment, the cover 100 is constructed of a material having two layers 102 and 104, as shown in FIG. 4B, with the upper layer 102 being cloth and the lower layer 104 being a waterproof material.

When the cover is positioned on a stackable chair SC, as reflected in FIG. 2A, the back portion 42 covers the chair back B, the seat portion 44 covers the chair seat S, the left arm portion 46 covers the left arm LA of the chair and the right arm portion 48 covers the right arm RA of the chair. With the cover 40 positioned on a stackable chair SC, a young child YC can be secured to the chair SC by securing the child restraint belt 20 around the child's YC waist with one of the child's YC legs positioned on each side of the midsection 22, as shown in FIG. 1.

When a child is secured to a chair with the chair cover with child restraint belt 10, the child is safely secured to the chair and the chair is protected from stains caused by the child. Likewise, the child is protected from any stains or harmful material that may have been left on the chair by a previous occupant. The chair cover with child restraint belt 10 prevents the child from falling through the opening between the back and seat of the chair or the openings in the arms. Additionally, the child is secured in an upright sitting position, which helps train a young child to sit in an upright barrier to help prevent the child's toys, shoes or other items from falling off of the chair.

Figure 5:
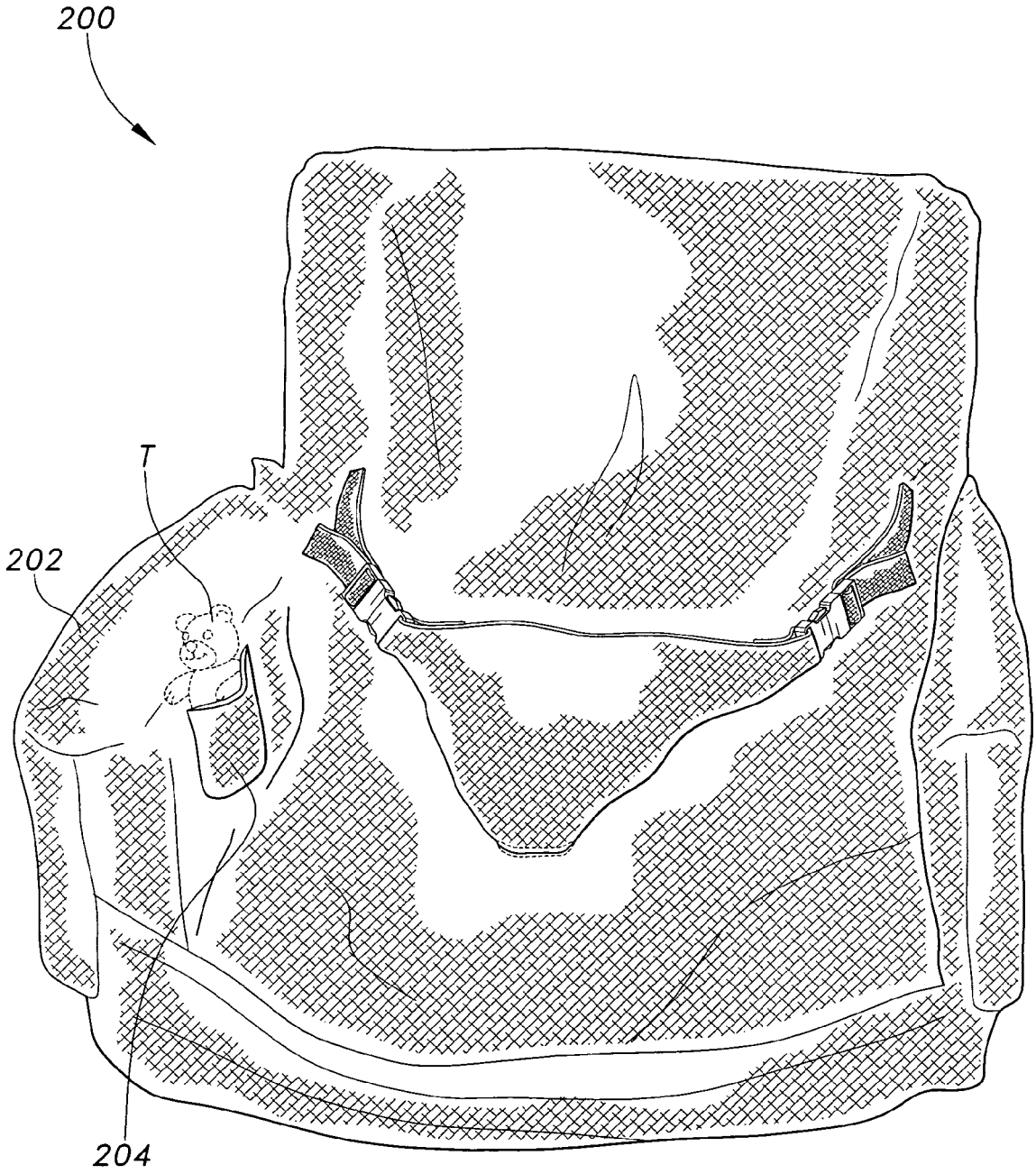
FIG. 5 is a perspective view of a third alternative embodiment of a chair cover with child restraint belt according to the present invention.

In an alternative embodiment shown in FIG. 5, the chair cover with child restraint belt 200 includes a pocket 204 on the inner aspect of the left arm portion 202. The pocket 204 allows a child sitting in the device 200 to store a toy T or other item therein 204. In all other respects the chair cover 200 is identical to the chair cover 10 of the first embodiment. In other embodiments, the chair cover with child restraint belt can include one or more pockets located on either the inner or outer aspects of either arm portion. The size and shape of the pocket or pockets may vary.

The chair cover with child restraint belt 10 is not limited to use with a stackable chair but can also be used on other types of chairs having a back and arm rests. Additionally, the cover 10 may be custom made to fit any size stackable chair, or other type of chair.

It is to be understood that the present invention is not limited to the embodiments described above, but encompasses any and all embodiments within the scope of the following claims.

I claim:

1. A chair cover with child restraint belt, comprising:

a cover adapted to fit over an upper portion of a chair, said cover having a back portion, a seat portion, a left arm portion and a right arm portion, each said back portion, said left arm portion, and said right arm portion including an inverted pocket adapted to fit over corresponding portions of the upper portion of the chair;

wherein said cover is formed from at least one layer of absorbent material between two layers of cloth material;

a belt, said belt comprising:

a first strap, a second strap, and a midsection;

said first strap and said second strap each being attached to said back portion of said cover, said first strap and said second strap each including first buckle portions;

said midsection having a lower edge attached to said seat portion of said cover, said midsection further including two arms, each of said two arms having a second buckle portion configured to releasably mate with one of said first buckle portions on said first and second straps, wherein when said second buckle portions of said midsection are mated with the first buckle portions on said first and second straps said belt is adapted to receive a user's legs while fastening said belt around the user; and a retaining panel affixed to and extending upwardly from a front edge of said seat portion, said retaining panel including a pair of ends that are removably attached to said left arm portion and said right arm portion, respectively;

wherein said retaining panel extends upwardly at the front edge of said seat portion, spanning the distance between said left arm portion and said right arm portion, and provides a barrier to prevent items from falling off the seat portion of the cover.

2. The chair cover according to claim 1, wherein said retaining panel is removably attached to said left arm portion and said right arm portion by a plurality of releasable fasteners attached to said retaining panel, said left arm portion and said right arm portion.

3. The chair cover according to claim 2, wherein said releasable fasteners comprise buttons and buttonholes.

4. The chair cover according to claim 2, wherein said releasable fasteners comprise mating patches of hook and loop material.

5. The chair cover according to claim 2, wherein said releasable fasteners comprise mating snap fasteners.

* * * * *